US005996672A

United States Patent [19]

Kotin

[11] Patent Number: 5,996,672

[45] Date of Patent: Dec. 7, 1999

[54] WOODEN SLAT FOR A WINDOW COVERING

[75] Inventor: Jay S. Kotin, Irvine, Calif.

[73] Assignee: Hunter Douglas Inc., Upper Saddle River, N.J.

[21] Appl. No.: 09/049,164

[22] Filed: Mar. 26, 1998

Related U.S. Application Data

[60] Provisional application No. 60/041,714, Mar. 27, 1997.

[51] Int. Cl.[6] ..... E06B 3/10

[52] U.S. Cl. ..... 160/236; 49/92.1

[58] Field of Search ..... 160/236, 173 R, 160/173 V, 232; 49/92.1

[56] References Cited

U.S. PATENT DOCUMENTS

| | | | |
|---|---|---|---|
| 2,091,012 | 8/1937 | Pratt | 160/236 |
| 2,275,975 | 3/1942 | McGlone | 160/236 |
| 2,534,673 | 12/1950 | Holland | 160/236 |
| 2,926,729 | 3/1960 | Zanini | 160/236 |
| 3,645,317 | 2/1972 | Malone | 160/236 X |
| 4,333,509 | 6/1982 | Conn | 160/173 R |
| 4,353,404 | 10/1982 | Trantow | 160/236 |
| 4,519,435 | 5/1985 | Stier | 160/236 |
| 4,773,958 | 9/1988 | Goodman | 160/236 |
| 4,818,590 | 4/1989 | Prince et al. | 160/236 X |
| 4,884,615 | 12/1989 | Hsu | 160/236 |
| 4,930,562 | 6/1990 | Goodman | 160/236 |
| 4,936,048 | 6/1990 | Ruggles | 160/236 X |
| 5,121,785 | 6/1992 | Ohsumi | 160/236 |
| 5,141,042 | 8/1992 | Schwaegerle | 160/236 |
| 5,601,132 | 2/1997 | Goodman | 160/236 |

*Primary Examiner*—David M. Purol
*Attorney, Agent, or Firm*—Dorsey & Whitney LLP

[57] ABSTRACT

A slat or rail used in a covering for an architectural opening includes a wooden core or the like that is wrapped with a flexible film of foil, paper or the like with the film bonded to the core with a Polyurethane Reactive (PUR) hot melt adhesive that provides a moisture free barrier around the core. The core may be provided with grooves in which edges of the film can be inserted to facilitate an aesthetic attachment of the film to the core.

6 Claims, 3 Drawing Sheets

WOODEN SLAT FOR A WINDOW COVERING

CROSS-REFERENCE TO RELATED APPLICATION

This application is a non-provisional application corresponding to U.S. provisional application Ser. No. 60/041,714 filed Mar. 27, 1997.

FIELD OF THE INVENTION

The present invention relates to the field of slats, bottom rails and valences used in the construction of window coverings such as Venetian blinds, vertical blinds, and shutters. In particular the present invention relates to a slat, rail, or valance that is wrapped with a flexible film or a foil.

BACKGROUND OF THE INVENTION

Wooden slats are used in various forms of coverings for architectural openings such as Venetian blinds, vertical blinds and shutters. A typical Venetian wood blind is made from a plurality of intrinsic wooden slats that are horizontally suspended from ladder tapes. The ladder tapes are connected to tilt rods which enable one leg of the ladder tape to be drawn up relative to the other leg of the ladder tape causing the wood slats to tilt. When the plane of the slats is substantially parallel with the plane of the architectural opening, light does not transfer through the blind and the blind is considered closed. When the plane of the slats is perpendicular to the plane of the architectural openings, light transfers through the blind, between the slats, and the blind is considered open. The typical blind has a bottom rail. Lift cords are coupled to the bottom rail and then run through the slats or alternatively are routed through the ladder tapes along the outside edge of the slats into the headrail. The lift cords are used to raise or lower the slats of the blind. Lift cords are generally pinched in a cordlock to hold the cords in place.

Wooden slats are also used with vertical blind hardware. A vertical blind has a headrail which includes a plurality of carriers typically mounted on a tilt rod. The carriers are attached to hangers from which the vertical wood slats will hang. Rotation of the tilt rod by either a cord or wand causes tilting of the vertical wood slats and the carriers are laterally movable to horizontally stack the slats adjacent a side or sides of an architectural opening or evenly distribute them across the opening.

A typical slat may be made from wood or wood components with the wood typically being a premium grade basswood or poplar that has a minimum amount of sugar deposits, knots and other natural wood characteristics. Consumers desire consistency in the appearance of the wood blind slats. If there is a knot or mineral deposit on the slat, it is expected that this flaw will appear consistently over the surface of the blind. Because of the variability of natural products, this is a difficult problem to overcome.

Generally wood blind slats are painted with a white or off-white pigment that substantially covers the wood characteristic of the wood slat. The painting or staining process uses paints and stains dissolved in organic chemical solvents that result in emission of harmful volatile organic compounds (VOCs) into the air. VOC emissions must be controlled by elaborate and expensive emission control devices. The volatile organic solvents are either recovered or burned before entering the atmosphere.

A problem faced in the fabrication of prior art wood blinds is the sorting of the wood slat for comparable characteristics and color. Another problem is checking slat bow, warp and camber. Stability is an inherent problem in thin continuous pieces of wood such as those used for wood slats. This problem is exaggerated in long slats. Continued cutting of forests results in the use of smaller and younger trees for wood for the wood slats. This young, small wood has more defects, warping, and bowing. Changes in humidity and temperature also effect the stability of wood slats.

To solve the problem with inconsistencies in the grade of the wood and to allow for the use of less expensive materials, film wrap has been used to surround the wood slat. The film wrap comes in many patterns and colors. Suppliers use UV resistant inks and typically print a top coat over these inks. The use of a film wrap provides substantial control over the aesthetic look of the product. It also alleviates any randomness that is present in the wood grain.

In combination with film wraps, finger jointed or engineered wood can be used as further explained below. This type of wood uses several pieces of wood from either the same species or different species that are finger jointed together. Because of the joints, finger jointed wood cannot be used for stained wood blind slats. The finger joints and the variation in color between the jointed wood are obvious even when the slat is stained. This is not aesthetically acceptable. Finger jointed wood can be used for painted wood slats, but the use of this wood requires additional coats to cover the joints compared to the number of coats required for continuous wood pieces. Additional coats of paint cost more money.

The use of finger jointed wood solves several problems associated with film blind slats. However, to use finger-jointed wood, the wood substrate must be film wrapped to hide the fingerjoints. The main problem discovered with film wrapping a finger jointed wood substrate is that moisture will penetrate the film and be absorbed by the wood. Where similar woods are used in the finger jointed wood, this is not a problem. Where several species are used to make up a finger jointed slat, this can be a problem. Different woods will absorb different levels of moisture at different rates. This results in different rates of expansion and moisture content along the length of the slat, subsequently resulting in delamination of the film from the finger jointed wood.

Prior art film wrapped slats have had problems. In high humidity, the film will delaminate from the underlying wood slat substrate. The films are laminated to inexpensive wood slat substrate that has defects and experiences warping and bow, possibly even greater than a painted wood slat. In typical prior art film wrapped wood slats, moisture will penetrate into the wood causing expansion and contraction of the wood slat which will result in decomposing, delamination, warping, cracking or the like of the film.

Therefore, it is an object of this invention to create a film wrapped wood blind that is stable in heat and moisture, that will not delaminate, and that can use a wood slat substrate that is both stable and inexpensive.

SUMMARY OF THE INVENTION

The above discussed and other problems with the prior art are solved by the wrapped slat of the present invention. The present invention includes a rigid core that may be finger jointed or engineered wood and a flexible film or foil wrap bonded to the core with a moisture impervious adhesive, preferably a Polyurethane Reactive (PUR) hot melt adhesive. The film may be printed with UV stable inks for aesthetic purposes and is top coated with a protective coating.

The advantages of using finger jointed wood as a core are multifold. Finger jointed or engineered wood has been used for years in the molding and building industries. It is the accepted and preferred wood product for solid continuous wood products because of its price stability and general availability. Since several different wood species can be used in its manufacture, these species of wood can be leveraged to optimize pricing. Finger jointed wood is also desirable because it is free of the warping common with long continuous pieces of wood.

In the fingerjointing process, logs are sliced into boards. The boards are then defect cut into small pieces from six inches to twelve inches long, glued back together and then cut or molded to the desired profile. This process allows the wood mill to purchase very inexpensive grade lumber in several available species. Finger jointed products get their stability by never having any continuous long pieces of wood within a single length. However, because finger jointed wood is made from different woods and different woods absorb moisture at different rates, there is much expansion of the wood throughout the length of a finger jointed wooden slat which has caused delamination of the film from the wood in prior art film wrapped, finger jointed wooden slats.

After much investigation, it has been discovered that the use of a moisture impervious adhesive and preferably a Polyurethane Reactive (PUR) hot melt adhesive to laminate the film to the core overcomes the problems inherent in prior art film wrapped slats. A PUR adhesive has better moisture barrier properties than the film alone. The other advantage of the PUR adhesive is that it forms a very strong bond between the film wrap and the core of the slat. Because moisture does not readily penetrate the film/adhesive combination, a wood core will not expand and contract in humid conditions and therefore will not delaminate.

The wrapped slat of the present invention is manufactured in accordance with the following steps. The fingerjointed or engineered wood core, for example, is fed into a wrapper such as a Barberan profile wrapper (available from the Barberan Corporation of Spain) by an automated feed table. Within the wrapper, the PUR adhesive is applied to the back of the film wrap by a conventional hot melt glue roller system. The film, prior to the adhesive being applied, has been slit to an appropriate width to enwrap the wood core while leaving a small overlap. The film, once the adhesive is applied, is pressed into place using a series of rollers that are positioned along the length of the wrapping machine. The rollers are aligned to follow the profile of the wood core. It is preferred that the adhesive be cooled prior to the release of the pressure from the roller. A cooling station is included in the process to promote the cooling and setting of the adhesive.

To ensure uniformity of the slat and to control the position of the film seam on the core and the size of the overlap, presizing of the cores is preferred. This can be done by using cores that are slightly wider than required and grinding or shaving off excess material to hold a predetermined dimension. During the presizing of the core, an edge of the core can be milled to form a groove extending the full length of the core. One edge of the film wrap can be inserted into the groove, for improved strength and better control of the placement of the film wrap seem and the other edge of the film wrap can be wrapped over the groove to cover the seam. As will be described later, two grooves can be milled in the core to facilitate the use of two separate film wraps for aesthetic purposes.

The foregoing and other objects, features and advantages will be more apparent from the following more particular description of the preferred embodiments of the invention as shown in the accompanying drawings.

DETAILED DESCRIPTION OF THE INVENTION

Figure 1A:
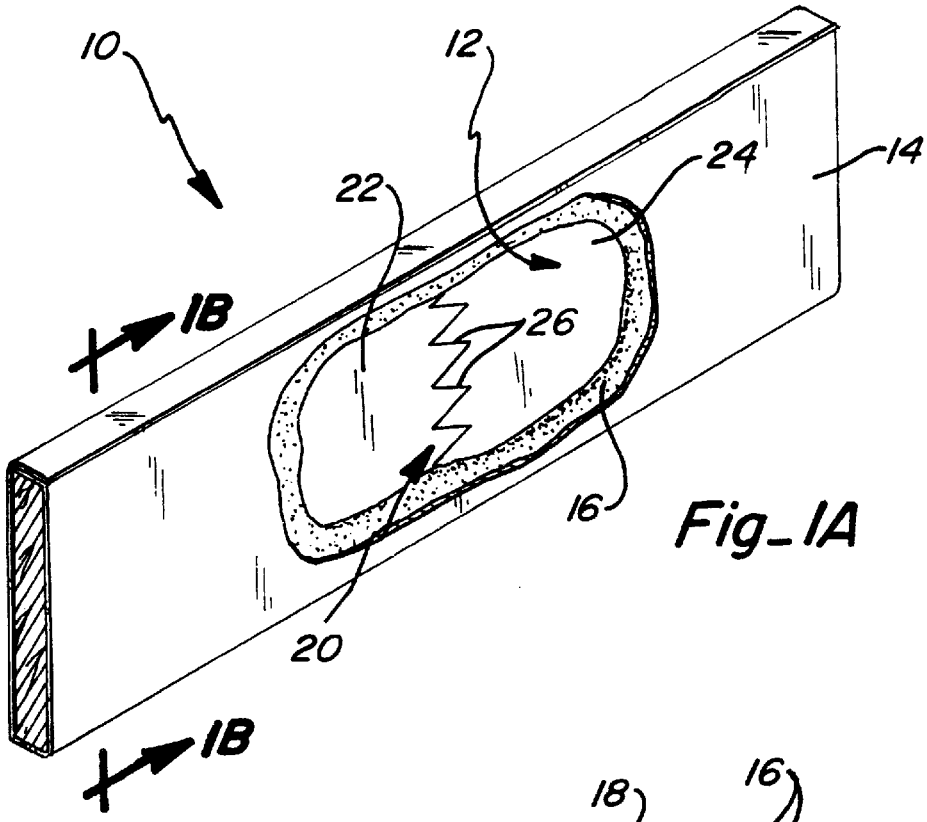
FIG. 1A is an isometric view of a wood slat in accordance with the present invention with parts removed for clarity.
Figure 1B:
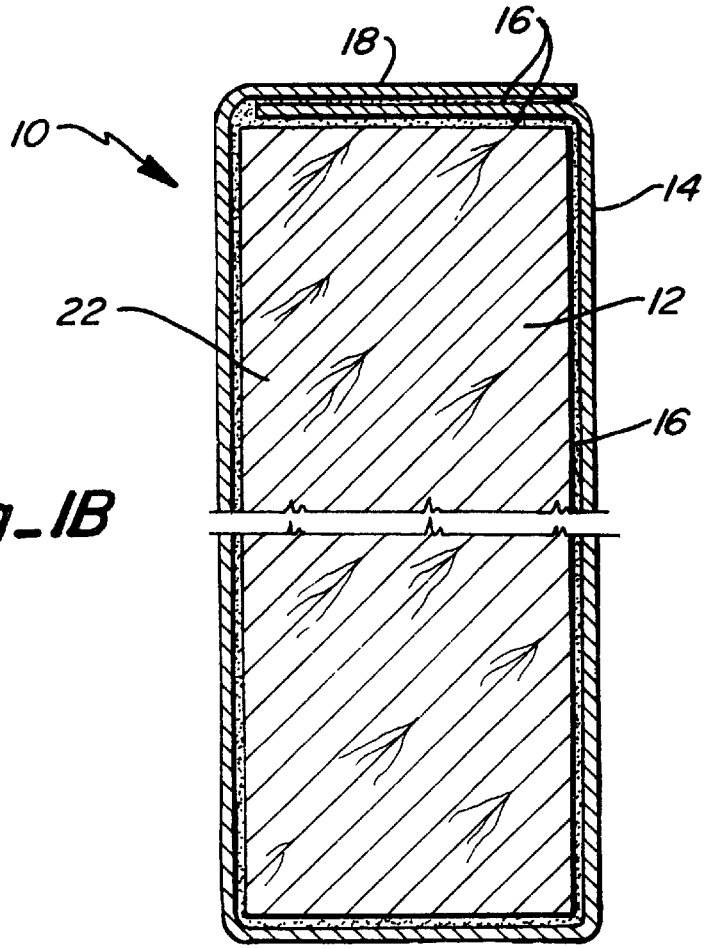
FIG. 1B is an enlarged vertical section taken along line 1B—1B of FIG. 1A with parts removed for size considerations.

Referring to FIGS. 1A and 1B, a first embodiment of the wrapped slat of the invention is shown generally as 10. The slat is made of a core or substrate 12 wrapped with a printed film 14 that is adhesively bonded to the core 12 with a moisture impervious adhesive 16.

The core 12 is preferably a finger jointed, narrow, elongated, rigid wooden strip also known as an engineered wood slat. A finger joint 20 connects two different pieces of wood 22 and 24. The finger joint 20 is made of a plurality of fingers 26 that interdigitate to create strength and surface area between the two pieces of wood 22 and 24. Other configurations may be used to bond several pieces of wood together to create an engineered wood slat, but fingerjointing is the most common, and the least costly. Other materials that can be used in place of wood for the core of the slat include multi-dimensional fiberboard, particle board, wheatboard, products such as polystyrene with or without pelletized wood flour, foamed PVC, rigid vinyl slats, and the like. A wood core 12 can be made of several pieces of wood all of the same or different species. Each different piece of wood would preferably be joined to one another at a finger joint 20. It is conceivable that a short wood core could have no finger joints in it and a long wood core could have a finger joint every foot or so.

The advantage of a slat having a wood core 12 in accordance with the present invention is that it is not prone to warpage and twisting. A typical engineered wood core will use a different piece of wood fingerjointed together every one to two feet. Because there is not a single continuous length of wood greater than about two feet in the core, a slat made from the engineered core is more stable. This stability comes from a short length of wood that even if it is exhibiting warping, prevents it from being noticeable, and since several pieces of wood may be used to make one slat, the latent instability of one piece of wood may be offset or dampened by another piece of wood in the core structure.

The various pieces of wood that make up a wood core 12 may be of the same specie or of different species. The advantage of this is that a wood mill can leverage various species, scrap, and defect prone wood to make a wood core of fairly high strength. By taking advantage of these and other aspects of wood choice, the cost of the engineered wood will be kept at a minimum and will be stable compared to use of a single specie or grade of wood.

The printed film 14 in the first embodiment is first cut to size and then is wrapped around the core 12 while leaving a small overlap 18 at an edge of the core as best seen in FIG. 1B. This overlap has a preferred dimension of 0.0625 inches to 0.125 inches. Slat 10 is longer than it is wide. Typically a core will have a width of two inches, a thickness of an eight of an inch and length determined by the dimension of the architectural opening in which the covering is used.

Figure 1C:
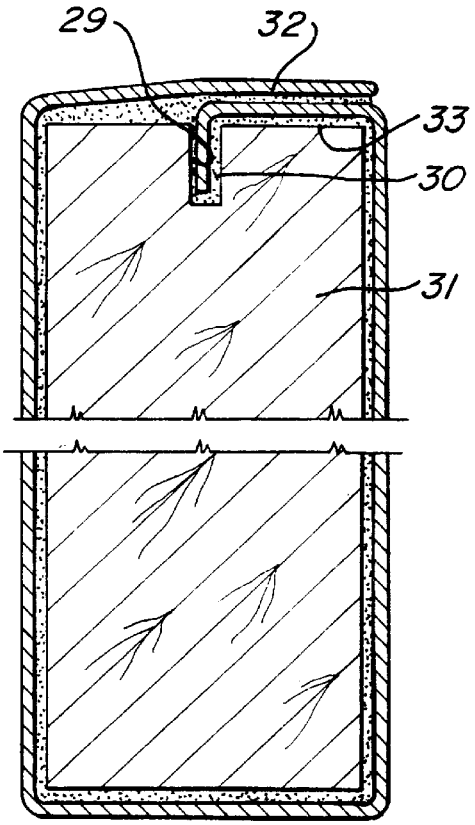
FIG. 1C is an enlarged section similar to FIG. 1B showing an alternative embodiment of the present invention.

An alternate overlap embodiment 28 is shown in FIG. 1C. In the embodiment shown in FIG. 1C, a longitudinal groove 29 is formed or milled in one edge 33 of the core 31 and a first edge 30 of the film is inserted into the groove. The film is wrapped around the core and a second edge 32 of the film overlaps the first edge 30 and the adhesive to be described later secures the film to the core as will be described later.

Figure 1D:
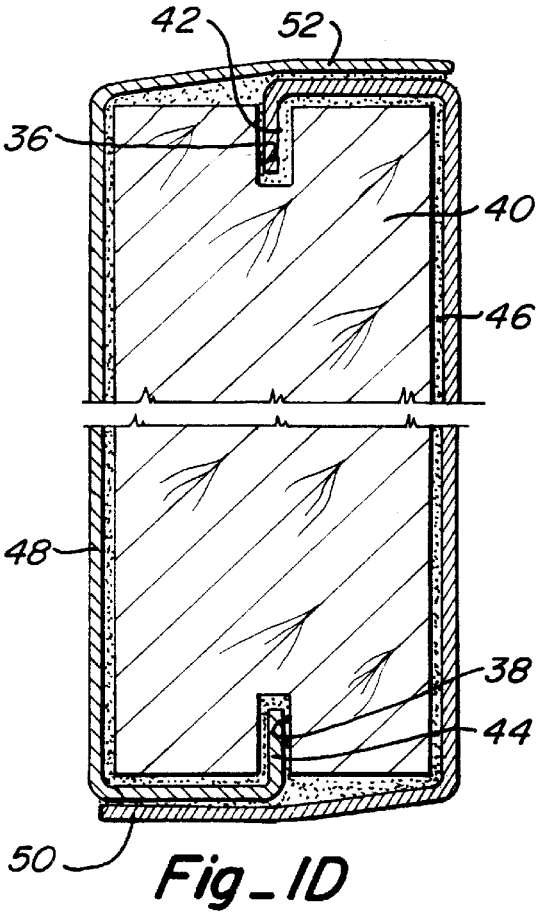
FIG. 1D is an enlarged section similar to FIG. 1B showing still another alternative embodiment of the present invention.

In still another embodiment 34 as shown in FIG. 1D, grooves 36 and 38 are formed or milled in each edge of the core 40 and a first edge 42 and 44 of two separate strips 46 and 48 respectively of film is inserted into a corresponding one of the grooves 36 and 38. The strips of film are about half the width of the film used in the configuration of FIG. 1A so that each strip of film covers approximately one face and one side edge of the core 40. A second edge 50 and 52 of each strip 46 and 48 respectively overlies the groove and edge associated with the other strip of film and is adhesively bonded in place with an adhesive as will be described hereafter. An advantage in using two strips of film resides in an ability to use film strips with different aesthetics so that opposite faces of a slat have different appearances.

The preferred moisture impervious adhesive 16 for securing the film to the core 12, 31 or 40 is a polyurethane reactive hot melt adhesive otherwise referred to as a PUR adhesive. PUR adhesives are one hundred percent solids adhesives. The polymers in the adhesive are not dissolved in a solvent that must evaporate for the adhesive to be effective. Typical one hundred percent solids adhesives are made of monomers that are caused to react to create the polymer in the adhesive. A well known example of this type of adhesive is a two part epoxy. Either part will not create a bond, but when the two parts are added together in the proper ratio, they react to create the epoxy polymer. In a PUR adhesive either an unreacted monomer is the starting material that is laid down or in the alternative an uncrosslinked polyurethane with sufficient monomer to cause further crosslinking is the starting material. When one or the other of these starting materials is exposed to moisture, the reaction is initiated or "kicked off" and the starting material is reacted to increase the crosslink density of the polyurethane. The more crosslinking that occurs, the more crystalline is the polymer that forms the adhesive. The more crystalline the base polymer, the better the moisture barrier properties of the adhesive.

As mentioned previously, when using a wood core 12, 31 or 40, moisture absorption is a problem. This holds true for both engineered wood cores (which are preferred) and cores made of a continuous length slat of a single wood. If the wood substrate absorbs moisture, it can swell, causing warpage, twist, and delamination of the film. To resolve this problem, the adhesive 16 used to laminate the decorative film 14 to the wood core 12, 31 or 40 has good moisture barrier properties. The adhesive also must have high strength. The type of polymer used for the adhesive and the degree of crosslinking within the polymer will dictate the moisture barrier properties of the adhesive. An example of the effect that crosslink density has on moisture barrier properties is between the various types of polyurethanes that are sold on the market. An ultrahigh density polyurethane has significantly better moisture barrier properties than a low density polyurethane. The crosslink density of the polymer in turn approximates the level of crystallinity within the polymer. A polyurethane that has a low crosslink density will not have the moisture barrier properties that a high crosslink density polyurethane will have.

The use of a polyurethane reactive adhesive will result in a highly crosslinked structure when exposed to moisture. This crosslinking results in an adhesive that both bonds the decorative film to the core and provides a good moisture barrier between the core and the atmosphere. Another advantage to the manner in which the decorative film is manufactured and then wrapped onto the core is that moisture barrier properties are enhanced when there are a number of boundary layers. If the decorative film includes an overcoat, there is a boundary layer formed between the overcoat and the decorative film and also between the PUR adhesive and the decorative film.

The wrapped slat of the present invention is made by feeding the core or substrate 12, which is preferably wood, into a wrapper (not shown), such as a Barberan Profile Wrapper manufactured by Barberan Corporation of Barcelona, Spain. The core is fed into the wrapper by a conventional automatic feed table. A pre-cut decorative film 14 is then fed into the wrapper. The PUR hot melt adhesive is subsequently applied to the back face of the film by a conventional hot melt glue roller system. Once the adhesive is applied, the decorative film is pressed into place using a series of rollers (not shown) provided along the length of the wrapping machine. These rollers are aligned to follow the contour of the core profile. Prior to releasing the roll pressure from the wrapped core, it is necessary to cool the structure. A cooling station (not shown) provides the necessary cooling to promote the setting of the adhesive.

Figure 2:
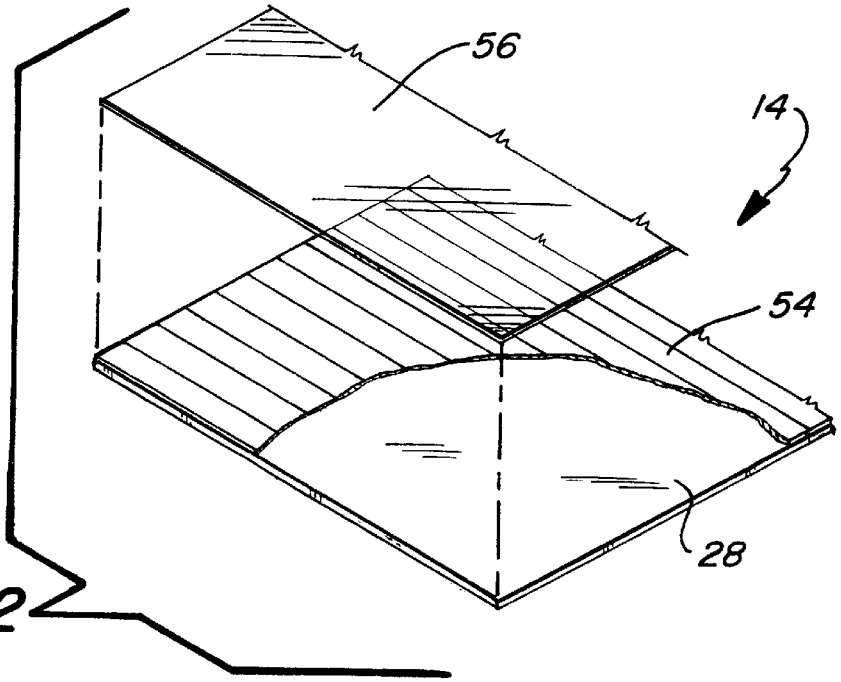
FIG. 2 is a fragmentary isometric exploded view of the film used in the present invention with portions of a decorative cover on the substrate of the film having been removed for illustrative purposes.

Now referring to FIG. 2, the decorative film 14 would typically have a plastic, paper, or the like substrate 28. There are four different types of preferred substrates. These are: a 30 gram coated paper with a polyurethane topcoat; an 80–100 gram embossed impregnated paper; a 4–6 mil vinyl; and polyolefin based plastic such as a polyester. These substrates are easy to print, ultraviolet stable, and will withstand the temperatures the wrapped slat will see in the architectural opening. Other films may include, but are not limited too, polypropylene and polyethylene, vinyl and various laminates of paper and film. An example of these films are supplied by Ranier Corp, a division of Gencorp located in the state of Mississippi, United States.

A pattern is printed onto the film substrate 28. The ink or other material 54 used to print or provide the pattern on the substrate is ultraviolet stable so that it will not fade in sunlight. It is also possible to incorporate an ultraviolet stabilizer into the polymer mix. It is possible to emboss the film substrate 28, prior to or after printing the substrate to add texture to the surface. A typical emboss pattern used for the wrapped slat would be that of a wood grain. Other emboss and print patterns may include marble, faux finishes other fashionable designs at the time. The wood grain emboss in conjunction with a wood grain print pattern provides both the look and feel of a wood product. An overcoat 56 may be applied over the printed film substrate. The overcoat 56 is preferably clear and provides toughness to the surface of the film so that the printed pattern 54 cannot be easily scratched or marred. It can also add enhanced moisture barrier properties and ultraviolet protection. A typical overcoat 56 is a polyurethane emulsion dispersed in a solvent that can include water. While an overcoat is preferred, it is not necessary for the practice of the present invention.

Figure 3:
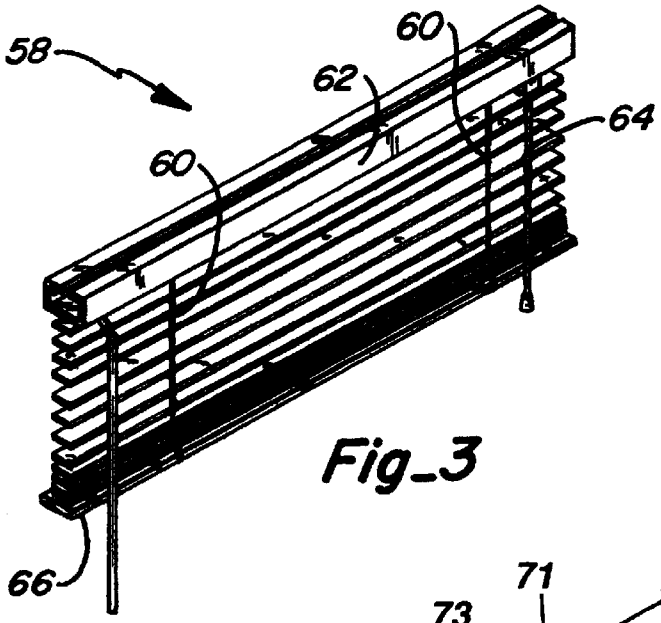
FIG. 3 is an isometric view of a Venetian blind-type produce incorporating the wood slat of the present invention.

Referring to FIG. 3, a plurality of wrapped slats 12, 31 or 40 in accordance with the present invention are shown suspended in a Venetian blind hardware system 58. The slats are suspended on a pair of ladder tapes 60. The ladder tapes are coupled to a tilt rod (not shown) contained within a headrail 62. A pair of lift cords 64 are positioned adjacent the ladder tapes 60. The lift cords may either run through the slats or pass in a sinusoidal fashion through the legs of the ladder tapes. Whichever method is used, the lift cord is joined to a bottom rail 66. The lift cords have sufficient length to pass through all the slats, into the headrail and then out of the headrail through an assembly called a cordlock (not seen). The cordlock allows the passage of the lift cords in either direction, but will pinch the cords when the cords are properly positioned relative to the cord lock.

A Venetian blind with wrapped slats operates the same as any other Venetian blind. The system shown in FIG. 3 and described above can be any of an assortment of Venetian blind operating systems, the improvement being the addition of the wrapped slat of the present invention.

Figure 4:
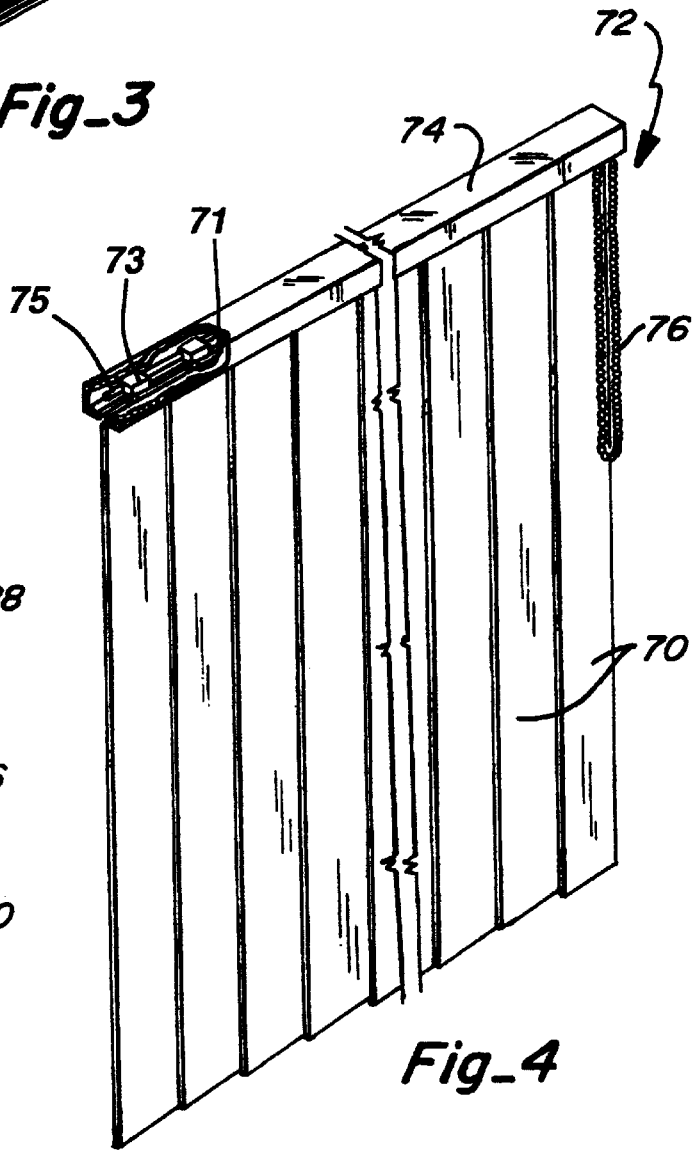
FIG. 4 is an isometric with parts removed for size considerations of a vertical blind-type covering incorporating wooden slats of the present invention.

Referring now to FIG. 4, a plurality of wrapped wooden slats or vanes 70 are suspended in a vertical blind 72. The slats 70 are coupled through hangers 71 and carriers 73 to a tilt rod 75 which is contained within a headrail 74. Attached to one end of the headrail and coupled to the tilt rod is an operating mechanism 76. The operating mechanism causes rotation of the tilt rod which subsequently causes rotation of the vanes or slats 70. The vanes or slats can be coupled to a traverse cord or wand (not seen) that when operated will either expand or contract the slats within a window or other architectural opening. By expansion or contraction of the slats it is meant that the plurality of slats defining the vertical blind are pulled all to the side or in contrast are positioned across the window equally distanced from one another. The wrapped slat or vane 70 of the present invention can be used in conjunction with any vertical blind hardware system.

Figure 5:
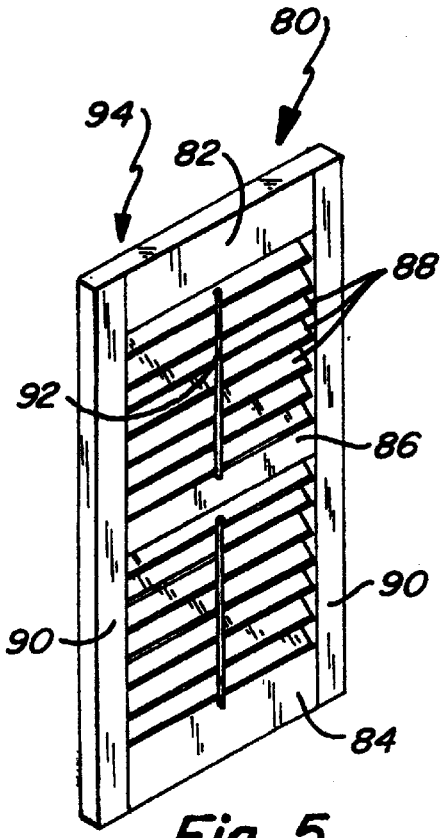
FIG. 5 is an isometric of a shutter incorporating wood slats in accordance with the present invention.

Referring now to FIG. 5, a shutter 80 used to cover architectural openings is shown. Shutter 80 includes a top rail 82, a bottom rail 84, a center rail 86, louvers, 88, a stile 90 and a tilt rod 92. Not all shutters are built alike and it is conceivable that other elements may be added to the shutter or withdrawn and the shutter system would continue to function. In a preferred embodiment the various elements of the shutter are wrapped and adhered to the base core pieces in accordance with method and materials described above for wrapping the core 12, 31 or 40. Of course only the louvers 88 could be wrapped and the frame 94 comprising the top rail 82, the bottom rail 84, the center rail 86, and the stile 90 could be painted or otherwise treated.

While the present invention has been disclosed in connection with the preferred embodiments thereof, it should be understood that there may be other embodiments which fall within the spirit and scope of the invention as defined by the following claims.

One such variation may be to apply a partial wrap of the decorative film over a wood substrate and treat the exposed wood with a coating to protect moisture incursion. Instead of completely wrapping the wood substrate, it is only partially wrapped.

Another variation may be to use fabric or cloth as a decorative film instead of those materials previously mentioned.

Another variation may be to use an adhesive that has moisture barrier properties but is not a polyurethane reactive adhesive. A variation of this may be to use a thermoplastic film with good moisture barrier properties that is laminated to the decorative film and is heated to its melt point prior to application to the core so it adheres to the core.

It is to be understood that while this detailed description of the present invention describes the wrapping of a wood slat and a wrapped wood slat, the same methods and materials apply to the wrapping of a valence and a bottom rail used with wood blinds. It also applies to the wrapping of the component parts used in shutters including the shutter slats.

I claim:

1. A wooden slat for a window covering comprising a finger jointed wood core having two substantially flat faces and two flat edges representing four corners, the corners being positioned at the intersection of the edges and the faces;

a printed film, having a first longitudinally extending edge and a second longitudinally extending edge, wrapped around said core in a manner so that the first edge of said film overlaps the second edge of said film and the first edge of said film is positioned at one corner of one edge of said core and the second corner is positioned at the next adjacent corner of the same edge of said core in said overlapping configuration; and a polyurethane reactive adhesive used to bond the film to the core so that the combination of said adhesive and said film creates a substantially moisture impervious barrier that prevents the core from warping.

2. The wooden slat of claim 1 wherein said film is printed with ink.

3. The wooden slat of claim 1 wherein said printed film is coated with an overcoat.

4. The wooden slat of claim 2 wherein said ink is ultraviolet stable.

5. The wooden slat of claim 1 wherein said wood core is made from at least two pieces of wood coming from different species of trees.

6. The wooden slat of claim 1 wherein said polyurethane reactive adhesive is a hot melt adhesive.

* * * * *